United States Patent [19]

Toto et al.

[11] B 3,998,542

[45] Dec. 21, 1976

[54] PHOTOCONDUCTOR STORING APPARATUS FOR AN ELECTROSTATIC COPIER

[75] Inventors: John A. Toto, Milford; William E. Pennings, S. Norwalk, both of Conn.

[73] Assignee: Pitney-Bowes, Inc., Stamford, Conn.

[22] Filed: June 20, 1974

[21] Appl. No.: 481,048

[44] Published under the second Trial Voluntary Protest Program on March 16, 1976 as document No. B 481,048.

[52] U.S. Cl. ..... 355/16; 226/119; 270/61 F; 270/79

[51] Int. Cl.[2] ..... G03G 15/00

[58] Field of Search ..... 355/16; 226/118, 119; 270/61 F, 79

[56] References Cited

UNITED STATES PATENTS

| | | | |
|---|---|---|---|
| 2,865,639 | 12/1958 | Gillesse et al. | 270/61 F X |
| 3,123,269 | 3/1964 | Morley et al. | 226/118 |
| 3,311,279 | 3/1967 | Yeiser | 226/118 |
| 3,464,610 | 9/1969 | Koning | 226/118 X |
| 3,724,838 | 4/1973 | Orlovsky | 270/61 F X |
| 3,756,488 | 9/1973 | Van Megan et al. | 226/119 |
| 3,836,138 | 9/1974 | Klepper | 270/61 F X |

*Primary Examiner*—Richard M. Sheer
*Attorney, Agent, or Firm*—Donald P. Walker; William D. Soltow, Jr.; Albert W. Scribner

[57] ABSTRACT

In a copier including a photoconductor having a plurality of photoconductive sections connected in series with one another to form an endless strip-type photoconductor, and including suitable instrumentalities for successively feeding the photoconductive sections from a zig-zag folded stack of such sections through several processing stations and back to the stack, there is provided apparatus for storing the photoconductive sections in the stack. The storing apparatus includes a receptacle having oppositely disposed walls defining an inlet opening and an outlet opening. The walls relatively converge towards one another from the inlet opening to the outlet opening, for guiding the folds of the photoconductive sections progressively closer to the outlet opening than the mid-portions thereof in transit through the receptacle. A pair of tamping devices, movably mounted on the opposite receptacle walls, cooperate with the receptacle walls for guiding incoming photoconductive sections toward the stack. In addition, apparatus is provided for moving the tamping devices out of step with one another toward and away from the stack, including, for example, one or more springs resiliently interconnecting the same to the respective tamping devices so as to maintain each of the tamping devices in engagement with the receptacle wall with which it is associated.

8 Claims, 5 Drawing Figures

PHOTOCONDUCTOR STORING APPARATUS FOR AN ELECTROSTATIC COPIER

BACKGROUND OF THE INVENTION

Electrostatic copiers provided with photoconductors of the type which include a plurality of photoconductive sections connected in series with one another so as to form an endless strip-like photoconductor, have been provided with suitable means for serially feeding the photoconductive sections from the bottom of a zigzag folded stack of such sections, at a storage station, through several processing stations and then to the top of the stack.

At the storage station of one known copier there has been provided apparatus for storing the photoconductive sections, including an elongated receptacle having a generally U-shaped transverse cross-section formed by a pair of oppositely disposed walls. The walls define an upper inlet opening through which processed photoconductive sections are successively fed to the top of the stack, and a lower outlet opening through which stored photoconductive sections are successively fed from the bottom of the stack. The receptacle walls extend downwardly and convergently toward one another from the inlet opening to the outlet opening, for guiding the folds of the photoconductive sections progressively closer to the outlet opening than the midportions thereof in transit through the receptacle. With this arrangement the stack is bowed upwardly within the receptacle to facilitate feeding the photoconductive sections from the bottom of the stack. The photoconductor storing apparatus also includes a pair of tamping devices, slidably attached to the opposite receptacle walls, and a pair of suitably driven rocker arms arranged to alternately lift the tamping devices and allow the same to fall, under the influence of gravity, against the opposite folds of the photoconductive sections as they are fed to the top of the stack. The tamping devices thus cooperate with the receptacle walls in guiding the folds of the photoconductive sections below the level of their respective mid-portions.

In the above described storing apparatus the photoconductive sections tend to resist being upwardly bowed. The forces exerted upwardly on the tamping devices often prevent the same from sliding as far downwardly on the receptacle walls as is permitted by the rocker arms. When the tamping devices are thereby disassociated from the rocker arms they can become cocked in place on the receptacle walls, or supported high enough on the receptacle walls to permit the same to interfere with the passage of the folds of the photoconductive sections to the top of the stack. Accordingly:

An object of the present invention is to provide an improved electrostatic copier; and Another object is to provide improved apparatus for storing photoconductive sections in a zigzag folded stack at the storage station of an electrostatic copier.

SUMMARY OF THE INVENTION

An electrostatic copier of the type which utilizes an endless strip-type photoconductor having a plurality of photoconductive sections connected in series with one another, and includes means for feeding the photoconductive sections to and from a storage station, is provided with improved apparatus at the storage station for storing the photoconductive section in a zigzag folded stack. The improved storing apparatus includes a receptacle having opposite walls forming inlet and outlet openings through which the photoconductive sections are respectively fed to and from the stack. To facilitate feeding the photoconductive sections from the stack, the receptacle walls relatively converge towards one another to guide the folds of the photoconductive sections progressively closer to the outlet opening than the mid-portions thereof in transit through the receptacle. A pair of tamping devices, movably engaging the opposite receptacle walls, each include means for guiding the incoming photoconductive sections toward the stack. To urge the tamping devices into contact with the stack, apparatus is provided for moving the tamping devices out of step with one another toward and away from the stack which includes means for resiliently interconnecting the same to the tamping devices.

BRIEF DESCRIPTION OF THE DRAWINGS

As shown in the drawings, wherein like reference numerals designate like or corresponding parts throughout the several FIGURES.

DESCRIPTION OF THE PREFERRED EMBODIMENT

Figure 1:
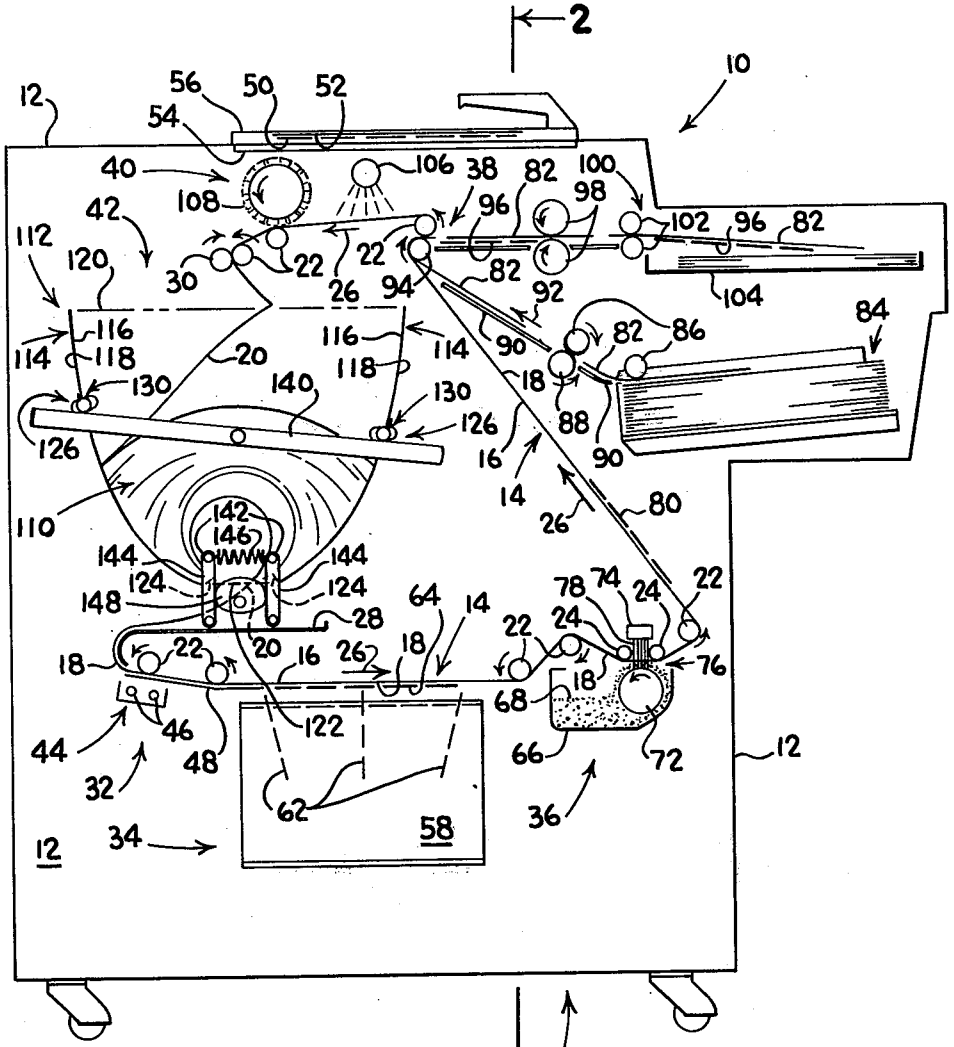
FIG. 1 is a schematic diagram, in elevation, of an electrostatic copier including a strip-type photoconductor having a plurality of series connected photoconductive sections folded on top of one another in a zigzag folded stack, and including prior art apparatus for storing the photoconductive sections in the stack.

As shown in FIG. 1, an electrostatic copier 10, of the type which may be improved in accordance with the present invention, generally includes suitable framework 12 for supporting the various components of the copier 10, including a photoconductor 14. The photoconductor 14 is made of a suitable strip of relatively stiff foldable material, having an inner surface 16 and an outer surface 18. The outer surface 18 is coated with a suitable photoconductive powder such as an oxide of zinc dispersed in a suitable binder either alone or in combination with a suitable plasticizer and a suitable dye sensitizer for extending the light sensitivity of the coating. And, the photoconductor 14 is divided into a plurality of photoconductive sections 20 of suitable length for folding purposes.

To movably support the photoconductor 14 (FIG. 1) within the copier 10, the copier 10 includes a plurality of elongated rotatable idler shafts 22, about which the photoconductor 14 is suitably endlessly looped, and a plurality elongated guide shafts 24. The shafts 22 and 24 are disposed parallel to one another and suitably secured to the framework 12 so as to longitudinally extend transverse to a desired path of travel 26 of the moving photoconductor 14. In addition, the copier 10 includes a guide plate 28 and a suitably driven elongated rotatable shaft 30. The driven shaft 30 is suitably secured to the framework 12 so as to extend parallel to the respective shafts 22 and rotate in engagement with the outer surface 18 of the photoconductor 14, for moving the photoconductor 14 in the aforesaid path of travel 26 from the guide plate 28 past a charging station 32, imaging station 34, developing station 36, transferring station 38 and cleaning station 40, to a storage station 42.

At the charging station 32 (FIG. 1), the copier 10 includes a suitably electrically energizeable corona charging device 44 including a pair of elongated, high-voltage, charging electrodes 46, suitably spaced from the moving photoconductor 14 and oriented relative to the same so as to longitudinally extend transverse to the photoconductor's path of travel 26, for depositing a uniformly distributed array of electrostatic charges 48 of suitable polarity on the photoconductor's outer surface 18.

Figure 2:
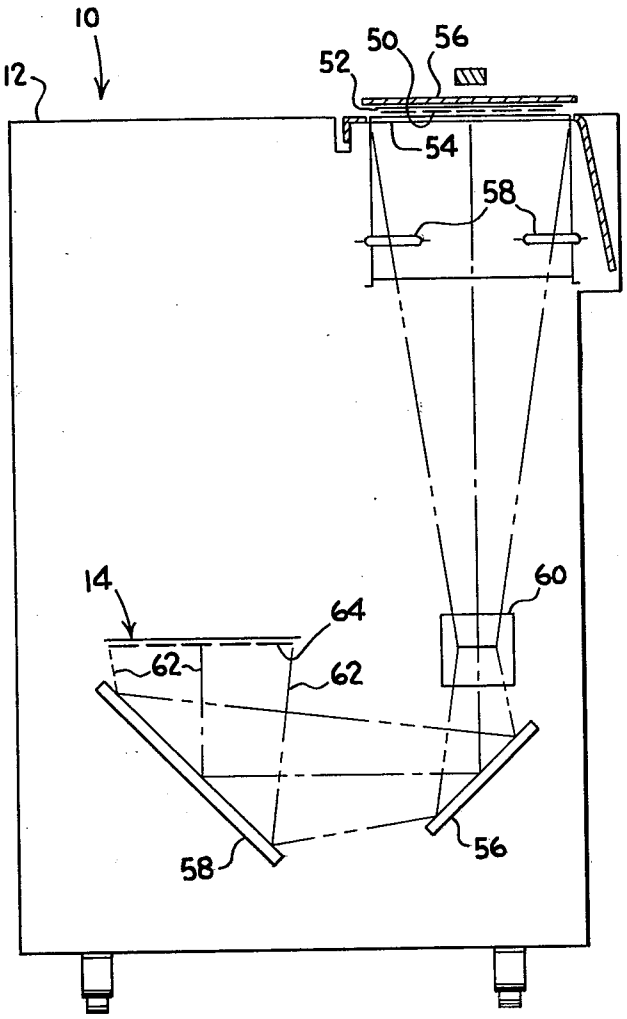
FIG. 2 is a cross-sectional, right side view, in elevation, of the electrostatic copier of FIG. 1, taken substantially along the line 2—2 thereof, showing a schematic diagram of the photoconductor imaging apparatus of the copier.

At the imaging station 34 the copier 10 includes means for providing the photoconductor 14 with information in the form of a graphic image 50 (FIG. 2) carried by a document 52 placed by the operator on a glass platen 54 secured to the copier's framework 12 beneath a cover 56. To that end, the copier 10 includes one or more electrically energizeable light sources 58, reflectors 56 and 58 and a lens 60 adapted by well-known means to cooperate with one another for illuminating the document 52 and flash exposing the photoconductor 14 with light 62 modulated by the graphic-image 50. The graphic-image modulated light 62 (FIG. 1) from the reflector 58 causes the photoconductor 14 to conduct and dissipate sufficient charge 48 from the photoconductor's outer surface 18 to provide the same with a developable electrostatic latent image 64.

At the developing station 36 (FIG. 1) the copier 10 includes a container 66 for locally holding a reusable supply of developing material 68, and developer material transporting means including a suitably driven elongated rotatable shaft 72 and an elongated permanent magnet 74 magnetically coupled to one another. The magnet 74 and shaft 72 are located on opposite sides of the photoconductor 14 and suitably secured to the framework 12 so as to longitudinally extend parallel to one another, out of contact with the moving photoconductor 14 and transverse to the photoconductor's path of travel 26. The rotating shaft 72 carries developer material 68 from the container 66 into a suitably narrow space 76 between the shaft 72 and photoconductor surface 18, wherein the magnetic field 78 of the magnet 74 brings carried developer material 68 into contact with the moving photoconductor 14. As a result, some of the toner material of the carried developer material 68 adheres to the electrostatic latent image 64 so as to render the image 64 visible; thereby forming a transferable, developed image 80 on the outer surface 18 of the moving photoconductor 14.

The developed image 80 (FIG. 1) is then transferred from the photoconductor surface 18 to a suitable supporting substratum, such as a sheet of paper 82. The paper 82 is fed to the transferring station 38 from a suitably supported paper stack 84 by means of a pair of suitably driven elongated rollers 86 cooperating with an elongated idler roller 88 and a pair of guide plates 90. The rollers 86 and 88 are oriented so as to longitudinally extend parallel to one another and transverse to the path of travel 26 of the moving photoconductor 14, and are suitably secured to the framework 12 for rotation in engagement with successive sheets of paper 82, to move the same from the stack 84 in a desired path of travel 92 on the guide plates 90 to the transferring station 38.

At the transferring station 38 (FIG. 1) the copier 10 includes an elongated, rotatable, idler shaft 94 suitably secured to the framework 12 so as to longitudinally extend parallel to the respective paths of travel 26 and 92 of the moving photoconductor 14 and sheet of paper 82. The rotating shaft 94 is disposed in engagement with the moving sheet of paper 82 and in sufficiently close proximity to the moving photoconductor 14 to forceably urge the paper 82 into intimate engagement with the image-bearing outer surface 18 of the moving photoconductor 14 to form a developed graphic image 96 on the sheet of paper 82. Preferably the shaft 94 is electrically energized by well-known means to provide an electric field of suitable polarity between the shaft 94 and next adjacent roller 22, tending to aid in transferring toner from the developed image 80 to the paper 82.

The graphic image 96 (FIG. 1) is thereafter fused to the paper 82 through the application of heat to the image 96. To that end, the copier 10 includes an image bonding device such as a pair of suitably heated elongated rollers 98. The rollers 98 are disposed parallel to one another and suitably secured to the framework 12 so as to longitudinally extend transverse to the path of travel 92 of the moving image-bearing sheet of paper 82. The rollers 98 are also suitably driven by well-known means in engagement with the sheet of paper 82 for feeding the bonded-image bearing paper 82 to a receiving station 100. At the receiving station 100 the copier 10 includes a pair of suitably driven paper feeding rollers 102 adapted by well-known means to engage and feed bonded-image bearing sheets of paper 82 to a suitable hopper 104 for retrieval by the operator of the copier 10.

After the developed image 80 (FIG. 1) 14 is transferred to a sheet of paper 82, the moving photoconductor 14 is guided to the cleaning station 40 by the idler roller 22 next adjacent to the transfer roller 94. At the cleaning station 40 the copier 10 includes a lamp 106 and a suitably housed and driven rotating brush 108. The lamp 106 is suitably secured to the copier framework 12 and disposed in sufficiently close proximity to the outer surface 18 of the photoconductor 14 to irradiate the photoconductive coating thereon in order to remove residual charge 48 from the coating. The brush 108 is suitably secured to the framework 12 so as to longitudinally extend transverse to the path of travel 26 of the moving photoconductor 14 and rotate in engagement with the same for removing any developer material 68 from the photoconductor 14 which was not transferred therefrom to the sheet of paper 82. The cleaned photoconductor 14 is thereafter fed to the storage station 42.

At the storage station 42 (FIG. 1) the copier 10 includes apparatus for temporarily storing a plurality of the photoconductive sections 20 on top of one another in a zigzag folded stack 110. In the prior art (FIGS. 1 and 3), the storing apparatus includes an elongated, open-ended receptacle 112 having a generally U-shaped transverse cross-section. The receptacle 112 includes a pair of oppositely spaced longitudinally-extending, curved, sheet metal side walls 114, each of which has an inner side surface 116 and an outer side surface 118. The side walls 114 are suitably secured to the copier framework 12 and form an upper inlet opening 120 and a lower outlet opening 122 (FIG. 3) through which the photoconductive sections 20 are respectively fed to and from the stack 110. The side walls 114 initially extend downwardly and slightly convergently toward one another from the inlet opening 120 and ten extend further downwardly and more convergently toward one another, curving through a total angle of approxiamtely 90°, to the outlet opening 122; and then extend upwardly and convergently toward another at an angle of approximately 45° from the horizontal, to form a pair of opposed lips 124 extending inwardly of the receptacle's outlet opening 122. The walls 114 (FIG. 1) thus extend relatively convergently towards one another from the inlet opening 120 to the outlet opening 122 for guiding the folds of the stacked photoconductive section 20 progressively closer to the outlet opening 122 then the mid-portions thereof in transit through the receptacle 112; to facilitate feeding the photoconductive sections 20 from the bottom of the stack 110 through the outlet opening 122.

To urge the opposite folds of the stacked photoconductive sections 20 (FIG. 1) toward the receptacle outlet opening 122, the storing apparatus includes a pair of oppositely-spaced tamping assemblies 126 (FIGS. 1 and 3), slidably movably mounted on opposite receptacle walls 114. The tamping assemblies 126 each include a pair of horizontally extending rods 128 (FIG. 3) located on opposite sides of the associated receptacle wall 114, and a pair of oppositely spaced end caps 130 fixedly secured to the adjacent ends of the associated rods 128. The attached caps 130 each include a yoke-like body portion 132 having a slot 134 for disposition of the caps 130 of a given tamping assembly 126 in reciprocating sliding engagement with the associated receptacle wall 114. In addition, the attached caps 130 each include a head portion 136 extending outwardly from the body portion 132 in the direction of the extension of the longitudinal lengths of the associated rods 128. And, the attached caps 130 each include a pair of flange portions 138 extending laterally from the body portion 132, in opposite directions, to restrict rotation of the sliding end caps 130 on the associated walls 114, and thus prevent excessive rotation of the sliding tamping assemblies 126 relative to the associated receptacle walls 114.

Figure 3:
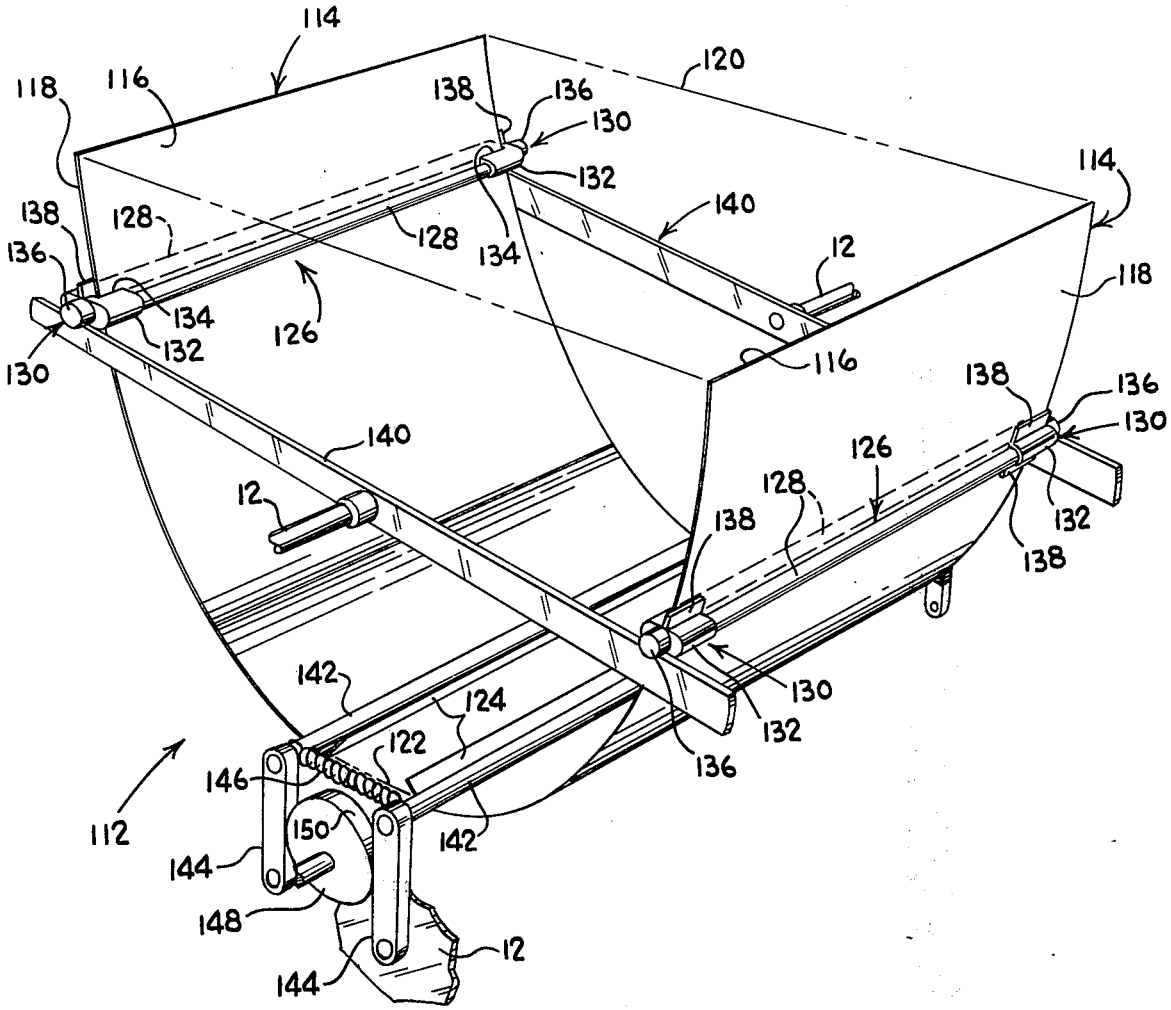
FIG. 3 is an enlarged, fragmentary perspective view of the prior art photoconductor storing apparatus schematically shown in FIG. 1.

The tamping assemblies 126 (FIG. 1) are moved out of step with one another, in and out of contact with the stack 110, to alternately tamp the opposite folds of the stacked photoconductive sections 20 toward the receptacle outlet opening 122. To that end, the copier storing apparatus includes a pair of oppositely spaced, suitably driven, elongated rocker arms 140 (FIGS. 1 and 3) extending across the opposite open ends of the receptacle 112 (FIG. 3). The arms 140 are suitably pivoted to the copier framework 12, approximately midway between their respective ends, and rocked in step with one another, clockwise and then counterclockwise, above and below the horizontal and thus alternately toward and away from the stack 110 (FIG. 1) and receptacle outlet opening 122.

To facilitate feeding the stacked photoconductive sections 20 (FIG. 1) one at a time from the bottom of the stack 110, the storing apparatus also includes a pair of elongated, oppositely spaced, parallel rods 142 (FIG. 3) extending lengthwise through the receptacle 112. And, at each end of the receptacle 112, suitable means for horizontally reciprocating the rods 142, sidewise, within the receptacle 112 including a pair of oppositely spaced links 144, an elongated tension spring 146 and a cam 148 having an outer surface 150. At each end of the receptacle 112, the links 144 are respectively suitably pivoted to and extend from the copier framework 12 to opposite rods 142; the spring 146 is attached to and extends between the rods 142 for holding the links in bearing engagement against the outer surface 150 of the cam 148; and the suitably driven cam 148 is attached to the copier framework 12 for rotation in bearing engagement with the links 144. The cam outer surfaces 150 are respectively suitably shaped to alternately pivot the links 144 relative to the copier framework 12, to reciprocate the rods 140 toward and away from the receptacle walls 114 for alternately holding and releasing the opposite folds of the photoconductive sections 20 at the receptacle lips 124. The drive (not shown) for the cams 148 and rocker arms 140 is controlled by well-known means to ensure horizontal reciprocation of the rods 142 in timed relationship with the vertical reciprocation of the tamping assemblies 126, to synchronize the movement of the rods 142 in and out of contact with the lowermost photoconductive section 20 (FIG. 1) in the stack 110 with the movement of the tamping assemblies 126 in and out of contact with the uppermost photoconductive section 20 in the stack 110.

In a copier 10 including the above described stacking apparatus, as each photoconductive section 20 (FIG. 1) is fed from the cleaning station 40 and enters the receptacle 112 via the inlet opening 120, one of the tamping assemblies 126 is slid upwardly and the other permitted to slide downwardly on the receptacle wall 114 with which it is associated. The upwardly sliding tamping assembly 126 is thereby raised out of contact with the stack 110 to permit the leading fold of an entering photoconductive section 20, and thus the trailing fold of the previously received photoconductive section 20, to be fed beneath the upwardly sliding tamping assembly 126. On the other hand, the downwardly sliding tamping assembly 126 is permitted to fall under the influence of gravity into contact with the leading fold of the previously received photoconductive section 20 to urge the latter, and thus the trailing fold of the next previously received photoconductive section 20, into contact with the top of the stack 110. Thereafter, the rocker arms 140 raise the tamping assembly 126 previously lowered to permit the next succeeding photoconductive section 20 to be fed therebeneath, and lower the tamping assembly 126 previously raised to permit the same to slide downwardly against the leading fold of the photoconductive section 20 then disposed therebeneath. Accordingly, the rocker arms 140 play an active role insofar as raising the tamping assemblies 126 is concerned, but play a passive role insofar as tamping the photoconductive sections 20 in place on top of the stack 110 is concerned. Of course, as each successive photoconductive section 20 enters the receptacle 112 for disposition on top of the stack 110, the photoconductive section 20 then disposed at the bottom of the stack 110 is pulled over the rods 142 and receptacle lips 124, and fed out of the receptacle 112 via the outlet opening 122 for disposition on top of the guide plate 28. Thus, as the supply of photoconductor sections 20 of the stack 110 is continuously depleted the stack 110 is replenished.

As the photoconductive sections 20 (FIG. 1) are urged toward the receptacle outlet opening 122 by the tamping assemblies 126, they tend to resist having the opposite folds thereof progressively urged closer to the receptacle outlet opening 122 than the respective mid-portions thereof. The folds exert an upwardly directed force on the tamping assemblies 126 and follow the upward movement of the same, thereby preventing the tamping assemblies 126 from sliding as far down on the receptacle walls 114 as is permitted by the downwardly moving rocker arms 140. When the tamping assemblies 126 are thus disassociated from the rocker arms 140 they may become cocked in place on the receptacle walls 114 above the usual level of disposition of the topmost photoconductive section 20 in the stack 110. Or, after relatively few oscillations of the rocker arms 140, the tamping assemblies 126 may become supported by a few of the photoconductive sections 20 above the lowermost level to which the rocker arms 140 permit the same to fall; as a result of which the tamping asemblies 126 are no longer raised by the rocker arms 140 a sufficient distance to permit the tamping assemblies 126 to significantly tamp the photoconductive sections 20. In at least the latter case the tamping assemblies 126 may interfere with the passage of the folds of the incoming photoconductive sections 20 to the top of the stack 110 and/or permit the photoconductive sections 20 to become stacked on top of either or both of the tamping assemblies 126; as a result of which several of the photoconductive sections 20 may be repeatedly lowered against the mid-portion of the stack 110 or otherwise unevenly distributed over the top of the stack. Eventually such shifts in the disposition of the weight of the photoconductive sections 20 within the receptacle 112 have resulted in the mid-portion of the stack 110 collapsing, mid-portion-first downwardly, toward the receptacle outlet opening 122.

Figure 5:
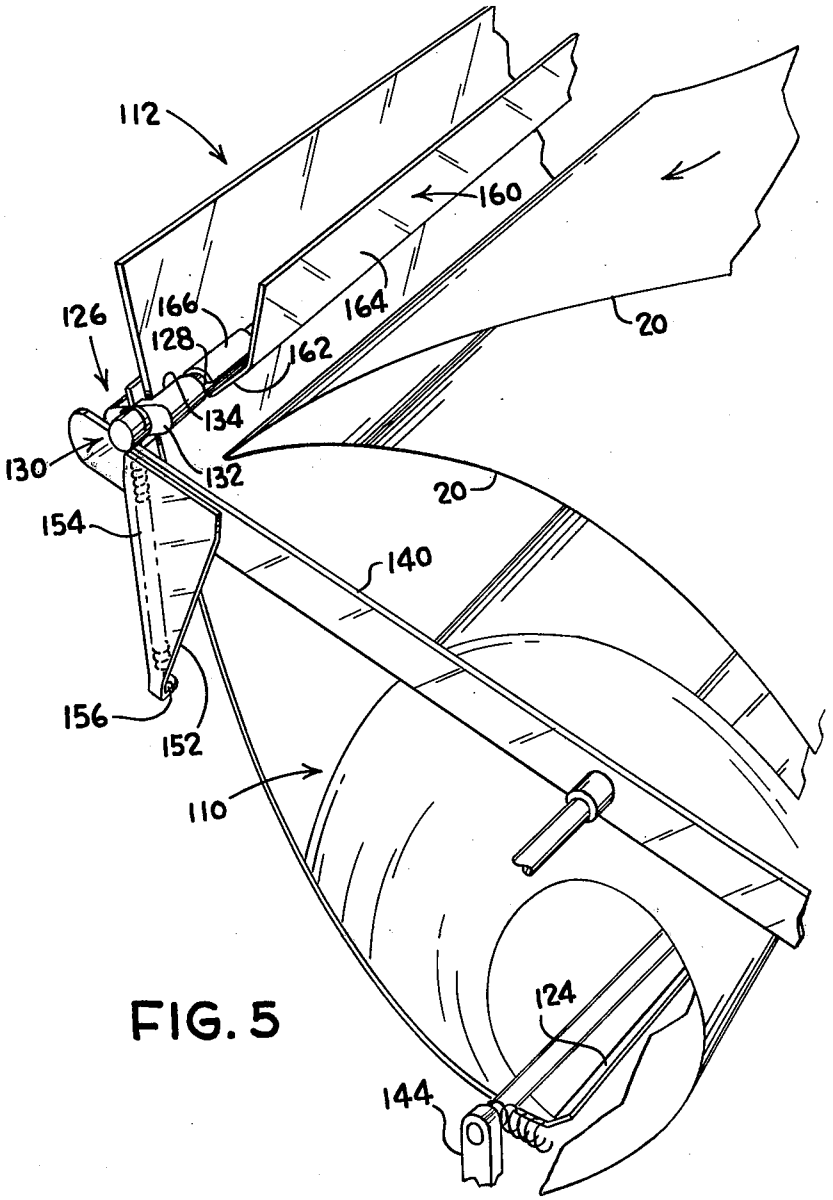
FIG. 5 is an enlarged, fragmentary perspective view of the photoconductor storing apparatus of FIG. 4.
Figure 4:
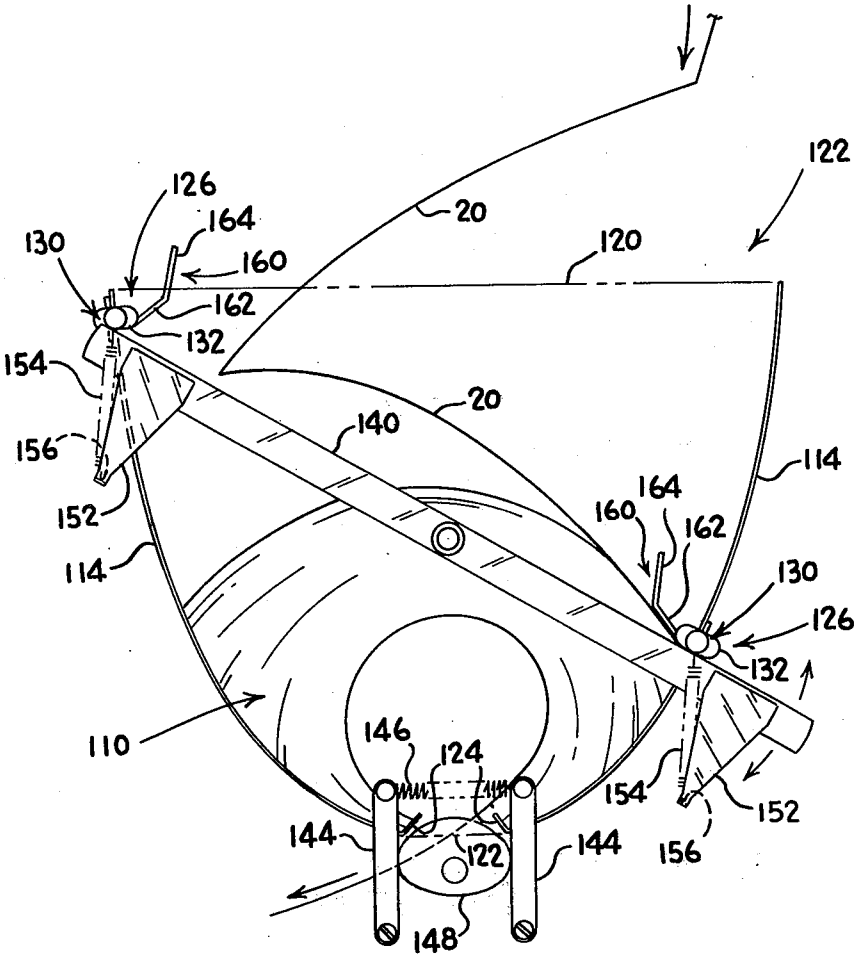
FIG. 4 is a reduced, fragmentary left end view, in elevation, of the photoconductor storing apparatus of FIG. 3, modified in accordance with the invention to include means for guiding photoconductive sections toward the fan-folded stack and means for resiliently urging the folds of the photoconductive sections below the respective mid-portions thereof in transit from the top to the bottom of the stack.

To prevent the tamping assemblies 126 from being disassociated from the rocker arms 140 the storing apparatus has been improved according to the invention to include means for resiliently interconnecting the tamping assemblies 126 to the rocker arms 140. To that end, the stacking apparatus includes a plurality of brackets 152 (FIGS. 4 and 5) and a like number of springs 154. Each of the brackets 152 is a generally triangularly-shaped metal plate having a spring retaining means such as a pin, stud or bent apex portion 156 suitably shaped to provide a bearing surface for the spring 154; whereas each of the springs 154 is an elongated circularly helically coiled spring. A pair of the brackets 152 are suitably fixedly secured to each of the rocker arms 140, one near each of the ends thereof, with the apex portions 156 projecting beneath the rocker arm 140 and toward the next adjacent tamping assembly 126. The springs 154 are prestressed and respectively have one end attached to a given bracket apex portion 156, and the other end attached to the next adjacent tamping assembly cap 130 between the cap's yoke-like body portion 132 and the rocker arm 140.

In addition, according to the invention, the storing apparatus has been improved to include means for guiding the incoming photoconductive sections 20 to the stack 110. To that end the tamping assemblies 126 respectively include an elongated sheet metal plate 160. Each of the plates 160 is substantially L-shaped in tranverse cross-section and has a pair of legs 162 and 164. The plate legs 162 each include a pair of spaced, partially-looped, portions 166 (FIG. 5) suitably dimensioned for partially surrounding a tamping assembly rod 128. The looped portions 166 of the respective plate legs 162 are suitably fixedly secured to the opposite tamping assembly rods 128 within the receptacle 112, as by welding. As thus secured, the respective legs 164 (FIG. 4) project towards one another, towards the receptacle inlet opening 120 and over the stack 110, for deflecting the folds of incoming photoconductive sections 20 toward the stack 110 and beneath the plate legs 162. In addition, the respective legs 162 project towards one another, towards the inlet opening and over the stack, at a lesser angle relative to the horizontal than the associated legs 164, for guiding the photoconductive sections 20 toward the stack 110 and tamping the same toward the receptacle outlet opening 122.

In the improved storing apparatus (FIGS. 4 and 5) the rocker arms 140 resiliently urge the tamping assemblies 126 into sliding engagement with the receptacle walls 114, and play an active role in lowering the respective tamping assemblies 126 into contact with folds of the incoming photoconductive sections 20 as well as spring urging the tamping assemblies 126 against the stack 110 to overcome the tendency of the photoconductive sections 20 to resist deformation. In addition, the plates 160 protrude a sufficient distance into the receptacle 112 to prevent photoconductive sections 20 which have been deflected therebeneath from upwardly overriding the tamping assemblies 126 as they are respectively raised. Preferably, the respective springs 154 are sufficiently prestressed to maintain the moving tamping assemblies 126 in sliding engagement with the rocker arms 140 with which they are associated, to overcome the upwardly directed forces on the tamping assemblies 126, thereby ensuring uniform deformation of the stacked photoconductive sections 20.

In accordance with the objects of the invention there has been described an electrostatic copier including improved means for storing photoconductive sections in a zigzag folded stack at the storage station of the copier.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. In a copier including a strip-type photoconductor having a plurality of photoconductive sections connected in series for folding on top of one another, and means for serially feeding the photoconductive sections to and from a storage station, apparatus for storing the photoconductive sections in a zig-zag folded stack at the storage station comprising:

a. a receptacle having an inlet opening and an outlet opening through which the photoconductive sections are respectively fed to and from the stack, said receptacle including a pair of oppositely spaced walls extending relatively convergently towards one another for guiding the folds of the respective photoconductive sections progressively closer to the outlet opening than the mid-portions thereof in transit through the receptacle;

b. a pair of tamping means respectively movably engaging opposite receptacle walls and cooperating therewith for guiding photoconductive sections toward the outlet opening; and c. means for moving the respective tamping means out of step with one another toward and away from the stack including means for resiliently interconnecting the respective tamping means to the moving means so as to maintain each of the tamping means in movable engagement with the receptacle wall associated therewith when the tamping means are moved toward and away from the stack.

2. The storing apparatus according to claim 1 wherein the tamping means respectively include an elongated plate, and said plates transversely-extending toward the receptacle inlet opening and partially over the stack for deflecting successive incoming photoconductive sections toward the stack.

3. In a copier according to claim 1 wherein the photoconductive sections each have a leading and trailing fold as fed to the receptacle, the tamping means respectively including an elongated plate protruding towards the receptacle inlet opening and partially over the stack for deflecting the leading and trailing folds toward the stack.

4. The storing apparatus according to claim 1 wherein the moving means engages the respective tamping means during movement thereof, and the resilient interconnecting means including a plurality of springs connected to urge the respective tamping means into sliding engagement with the moving means.

5. The apparatus according to claim 1 wherein the tamping means respectively slidably engage the receptacle wall associated therewith for movement thereon toward and away from the stack, and the means for resiliently interconnecting the moving means to the respective tamping means including a plurality of elongated springs for holding the respective tamping means in sliding engagement with the receptacle walls respectively associated therewith.

6. The apparatus according to claim 1 wherein the tamping means respectively include an elongated substantially L-shaped plate for guiding the incoming photoconductive sections to the stack, and the resilient interconnecting means including a plurality of prestressed tension springs disposed for urging the respective tamping means towards the stack.

7. The apparatus according to claim 1 wherein the tamping means each include a plate for urging the folds of stacked photoconductive sections progressively closer to the outlet opening than the mid-portions thereof in transit through the receptacle.

8. The apparatus according to claim 1 wherein the means for moving the respective tamping means includes a pair of rocker arms, the means for resiliently interconnecting the moving means to the respective tamping means includes two pairs of brackets, a pair of said brackets being fixedly attached to each of the rocker arms, the brackets attached to a given rocker arm being respectively associated with opposite tamping means, and the means for resiliently interconnecting the moving means to the tamping means including a spring connected to each bracket and to the tamping means associated therewith for urging the tamping means into sliding engagement with the rocker arms.

* * * * *